US011333435B2

(12) United States Patent
Zamparo

(10) Patent No.: US 11,333,435 B2
(45) Date of Patent: May 17, 2022

(54) HEAT TREATMENT INSTALLATION FOR PRODUCING INDUSTRIAL PRODUCTS

(71) Applicant: CERITHERM, Oradour-sur-Vayres (FR)

(72) Inventor: Giovanni Zamparo, Oradour sur Vayres (FR)

(73) Assignee: CERITHERM, Oradour-sur-Vayres (FR)

( * ) Notice: Subject to any disclaimer, the term of this patent is extended or adjusted under 35 U.S.C. 154(b) by 21 days.

(21) Appl. No.: 16/764,289

(22) PCT Filed: Nov. 6, 2018

(86) PCT No.: PCT/FR2018/052741

§ 371 (c)(1),
(2) Date: May 14, 2020

(87) PCT Pub. No.: WO2019/102092

PCT Pub. Date: May 31, 2019

(65) Prior Publication Data

US 2020/0348079 A1 Nov. 5, 2020

(30) Foreign Application Priority Data

Nov. 21, 2017 (FR) ..... 17 60986

(51) Int. Cl.
*F27B 11/00* (2006.01)
*F27B 19/02* (2006.01)
*F27B 17/00* (2006.01)

(52) U.S. Cl.
CPC ..... *F27B 11/00* (2013.01); *F27B 17/0016* (2013.01); *F27B 19/02* (2013.01)

(58) Field of Classification Search
CPC ..... F27B 11/00; F27B 17/0016; F27B 19/02
USPC ..... 266/255
See application file for complete search history.

(56) References Cited

U.S. PATENT DOCUMENTS 2,015,699 A * 10/1935 Trainer ..... C21D 9/0068 432/122
5,549,473 A * 8/1996 Valentian ..... B64G 1/22 414/172
5,722,825 A * 3/1998 Edenhofer ..... C21D 1/773 266/251
6,632,302 B2 * 10/2003 Fisher ..... C21D 9/0037 148/640

(Continued)

FOREIGN PATENT DOCUMENTS

DE 12 21 258 7/1966
FR 1 247 845 12/1960

OTHER PUBLICATIONS

International Search Report dated Jan. 22, 2019.

*Primary Examiner* — Jessee R Roe
*Assistant Examiner* — Michael Aboagye
(74) *Attorney, Agent, or Firm* — IPSILON USA, LLP

(57) ABSTRACT

A heat treatment installation is provided for production of industrial products. The heat treatment installation has several chambers with different thermal characteristics, including: a base (18) to accept the products (22) that are to be treated, a set of several chambers (3,4; 28,29,30) distributed about an axis (7), and mechanical means (6,10) to provide the relative movement of the base (18) and of the chambers (3,4; 28,29,30) and the coupling between a chamber and the base.

7 Claims, 4 Drawing Sheets

(56) References Cited

U.S. PATENT DOCUMENTS

| | | | | |
|---|---|---|---|---|
| 9,719,149 | B2 * | 8/2017 | Moller | F27D 3/00 |
| 10,273,553 | B2 * | 4/2019 | Katsumata | C21D 9/0062 |
| 2003/0113186 | A1 * | 6/2003 | Hiramoto | C21D 9/0018<br>414/147 |
| 2013/0153547 | A1 | 6/2013 | Katsumata | |

* cited by examiner

FIG 4
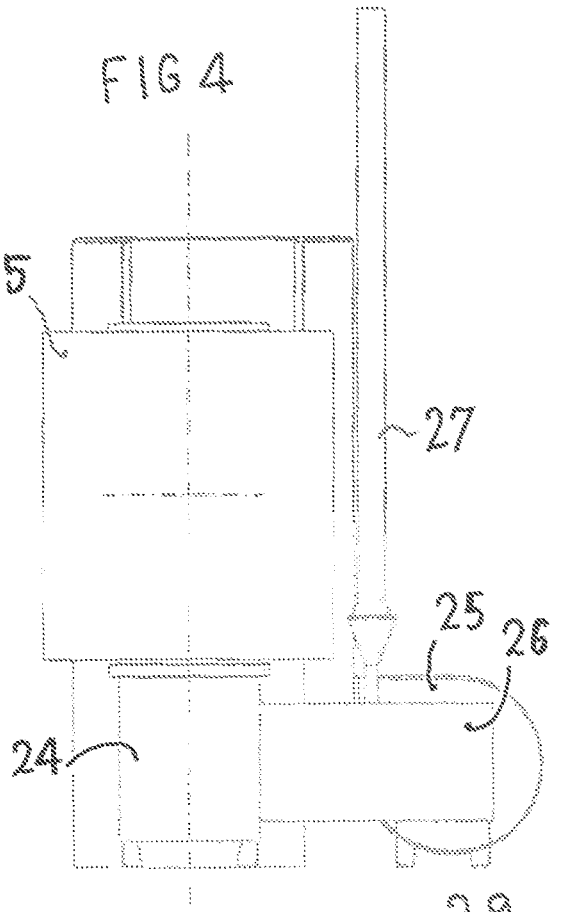
FIG 5
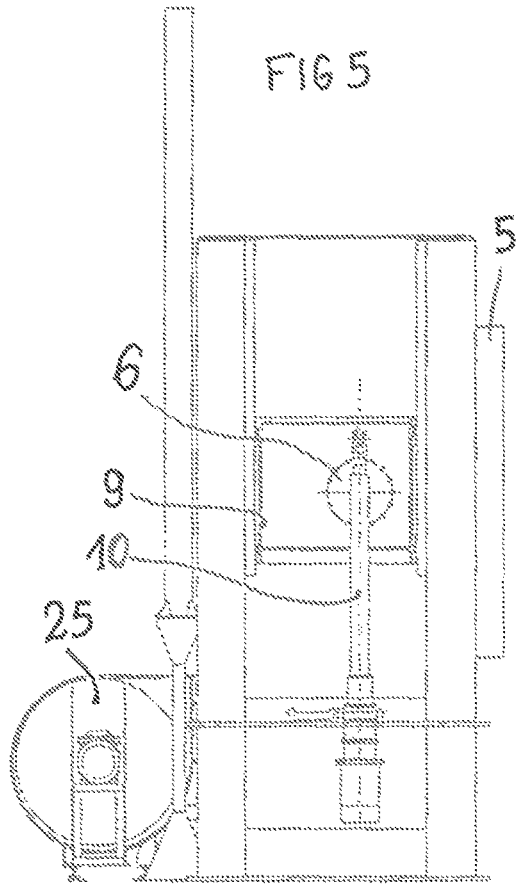
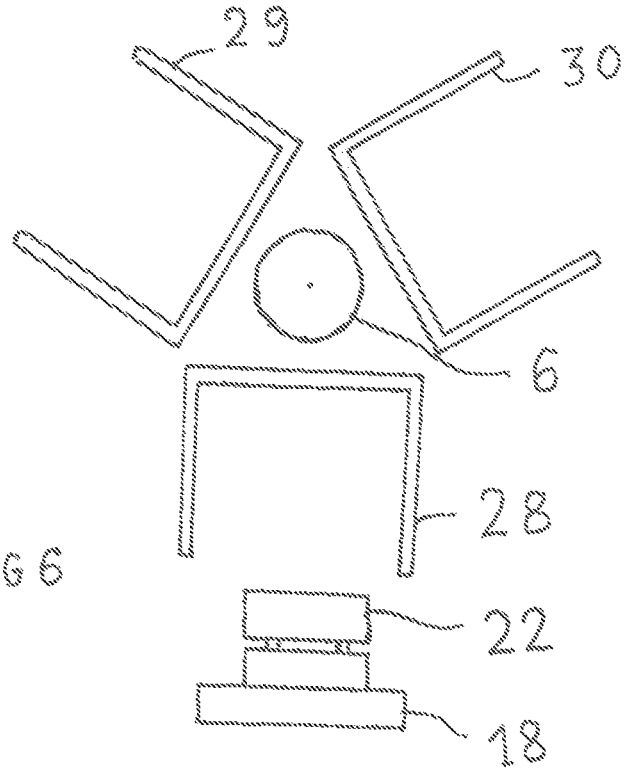
FIG 6

HEAT TREATMENT INSTALLATION FOR PRODUCING INDUSTRIAL PRODUCTS

RELATED APPLICATION

This application is a National Phase of PCT/FR2018/052741 filed on Nov. 6, 2018, which claims priority to French Patent Application No. FR 17 60986 filed on Nov. 21, 2017, the entirety of which are incorporated by reference.

FIELD OF THE INVENTION

The invention relates to a heat treatment installation for the production of industrial products, notably in the field of composite materials and/or of 3D printing.

PRIOR ART

In this field, the operations required for the production of the industrial products include heat treatments and/or treatments under a controlled atmosphere. These particular treatments are carried out in dedicated chambers in which the temperature, pressure and/or atmospheric conditions can be controlled and sustained over what can sometimes be lengthy periods. These chambers are, for example, relaxation chambers, binder-removal ovens for the removal of a manufacturing binder via evaporation or carbonization, firing kilns, drying or dewatering ovens. It is often the case in manufacturing processes that industrial products are treated successively in several chambers that have different functions, for example a drying chamber and a firing chamber, or a binder-removal chamber and a high-temperature sintering chamber. Because the chambers are each devoted to a particular treatment, the industrial products in the process of being manufactured are handled in such a way as to correspond to the location and particular layout of each chamber. They need to be distributed according to the availability of the chambers, their dimensional characteristics and the nature of the supports that they accept or dictate. Furthermore, because the chambers are specific, their treatment times are generally fixed.

Document FR 1 247 845 describes a device for firing ceramic products comprising three fixed chambers with different thermal characteristics, it being possible for the treatment temperature to reach 1400° C. The products that are to be treated are placed on a trolley that can be moved between the chambers.

Document DE 1221253 describes an electric heating oven with two opposite entrances which are used alternately for the cooling of the treated products and for supplying with products that are to be treated. There is just one chamber that is active and the products that are to be treated are moved horizontally using trolleys.

In the case of innovative industrial products employing heat treatments, the treatment times need to be adapted to suit. One disadvantage stems from the need to transfer products from one treatment chamber to another with the spatial layout of the products being adapted to suit the volume available in each chamber. The handling operations associated with these transfers are the source of numerous difficulties. They may give rise to defects in the components. They disrupt the rapid sequencing of the treatment operations and automation thereof. They represent a significant investment cost and often require the presence of operators to monitor them. They lead to variations in the temperature of the products, generally to cooling, between the various treatment phases, and this represents at once a risk to the quality of the products, a not-insignificant waste of energy, and a loss in terms of the productivity of the installation.

OBJECTS AND SUMMARY OF THE INVENTION

One of the objects of the invention is to propose a heat treatment installation for the production of industrial products that avoids the aforementioned disadvantages.

Another object of the invention is to propose a heat treatment installation for the production of industrial products in which the handlings of the products are reduced to the operations of placement prior to treatment and of removal post-treatment, without any intervention, between the heat treatment operations, regarding the spatial organization of the products corresponding to the stacking and the distribution of the products in the working treatment volume.

The subject of the invention is a heat treatment installation for the production of industrial products, comprising several chambers with different thermal characteristics, and a support comprising a base to accept the products that are to be treated, characterized in that: the support is stationary, the chambers are distributed about an axis, and mechanical means provide the relative movement of the base and of the chambers and the coupling between a chamber and the base.

According to one embodiment of the invention, the mechanical means comprise a motorized pivot for causing the set of chambers to pivot about the axis, and a hydraulic cylinder for causing the relative movement of the base and of the set of chambers.

According to one embodiment of the invention, the axis of pivoting of the chambers is a horizontal axis.

According to one embodiment of the invention, the relative movement of the base and of the chambers is a vertical movement.

According to one embodiment of the invention, the vertical movement is a movement of the chambers with respect to the base.

According to one embodiment of the invention, the vertical movement is a movement of the base with respect to the chambers.

According to one embodiment of the invention, the set of chambers comprises two chambers.

According to one embodiment of the invention, the set of chambers comprises three chambers.

BRIEF DESCRIPTION OF THE FIGURES

FIG. 4 is a view from the left of the heat treatment installation of FIG. 3.

FIG. 5 is a view from the right of the heat treatment installation of FIG. 3.

FIG. 6 is a schematic view of a heat treatment installation according to the invention, equipped with three chambers.

DETAILED DESCRIPTION

According to a first embodiment of the invention, the heat treatment installation for the production of industrial products is essentially made up of a fixed support 1 for receiving the industrial products that are to be treated, and of a fixed gantry 2 bearing several heat treatment chambers.

Figure 1:
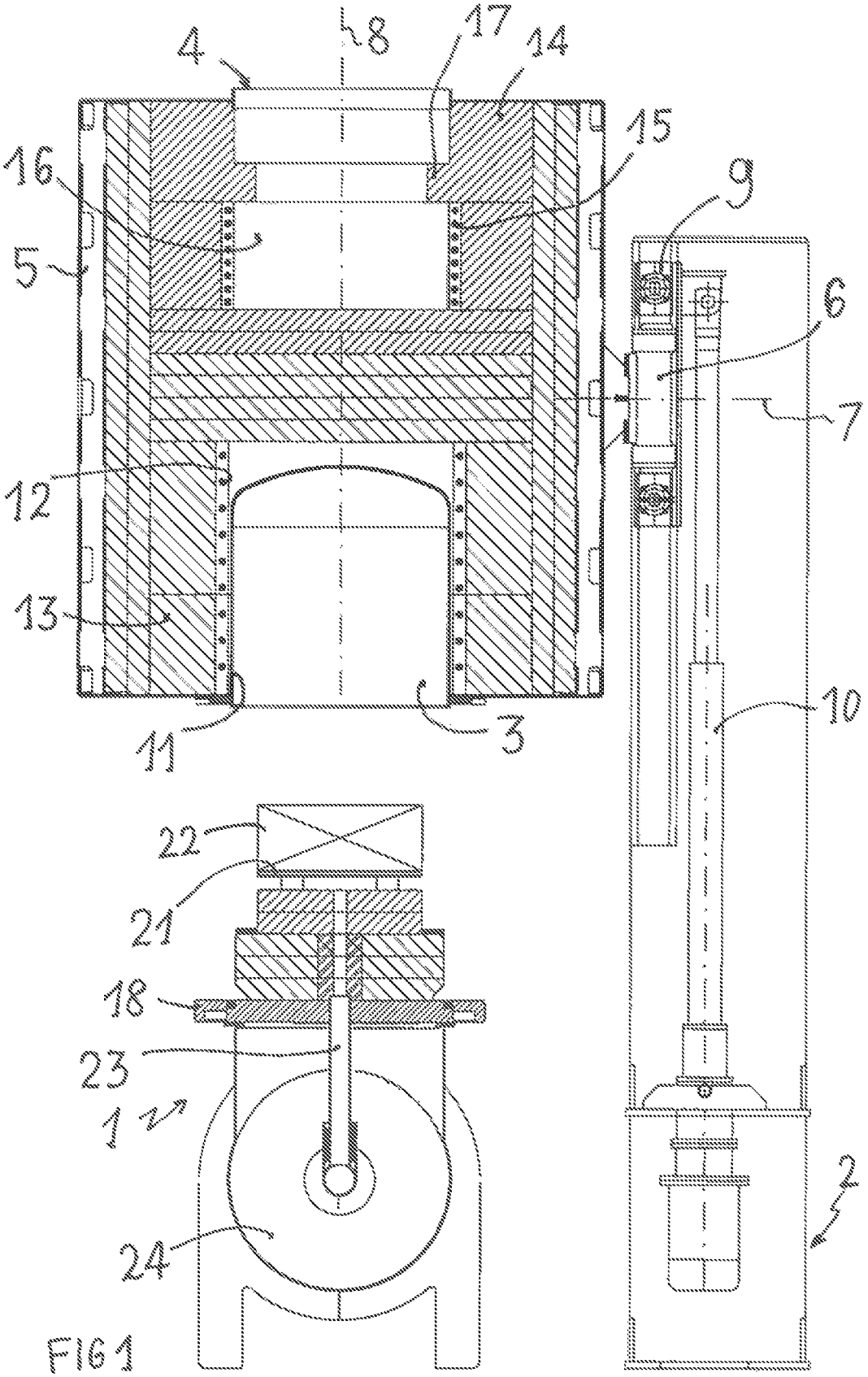
FIG. 1 is a view in vertical section of a heat treatment installation for the production of industrial products according to the invention prior to the placement of the products in a stabilization and/or binder-removal first chamber.

In the embodiment of FIG. 1, the chambers are a stabilization and binder-removal chamber 3, and a high-temperature sintering chamber 4. The two chambers 3 and 4 are housed in a bearing structure 5 fixed to a motorized pivot 6 of horizontal axis 7 borne by the gantry 2. In FIG. 1, the two chambers 3 and 4 have a common vertical axis 8, the stabilization and binder-removal chamber 3 being positioned with its opening above the fixed support 1.

Figure 2:
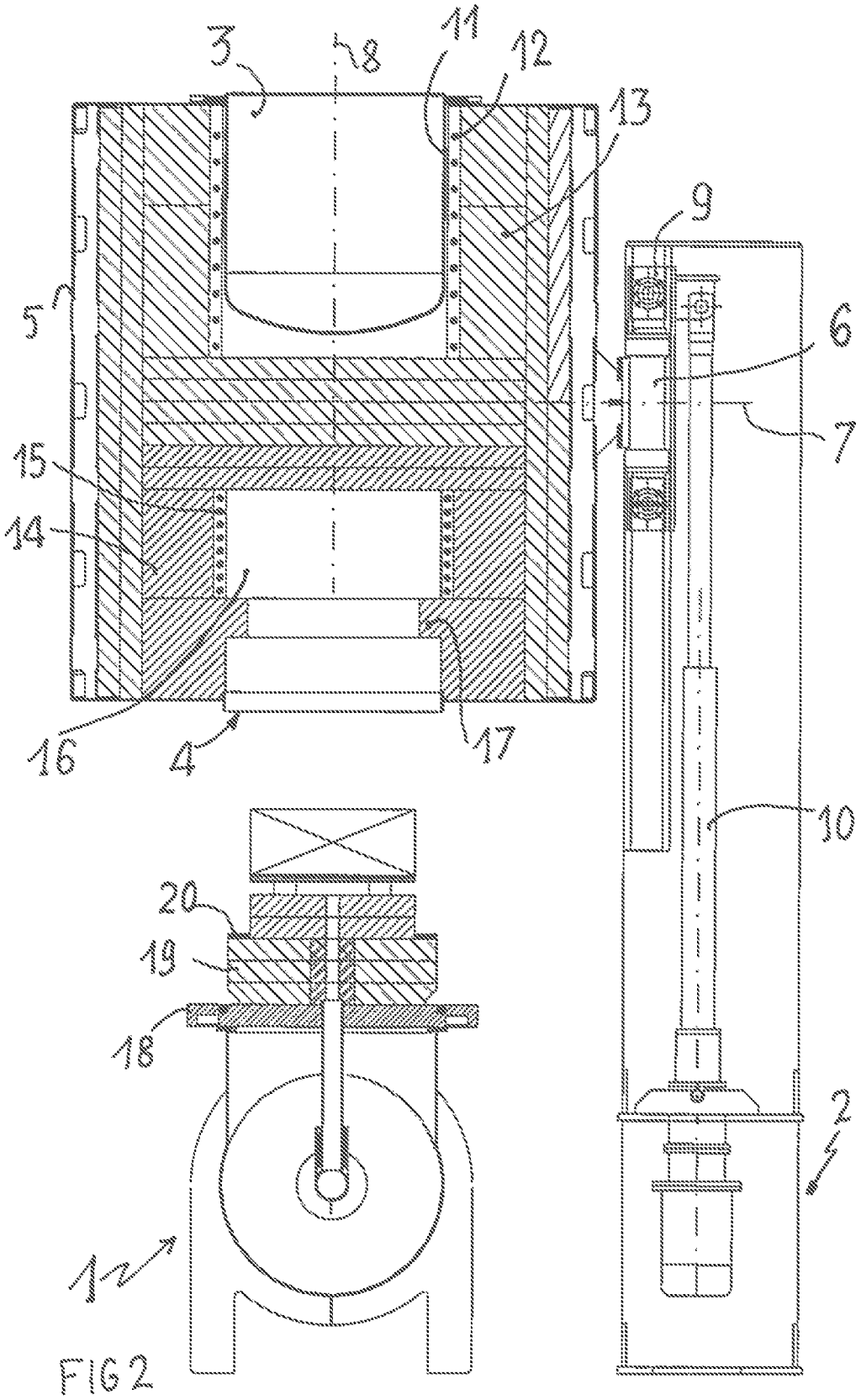
FIG. 2 is a view in vertical section of the heat treatment installation of FIG. 1, prior to placement of the products in a high-temperature sintering second chamber.
Figure 3:
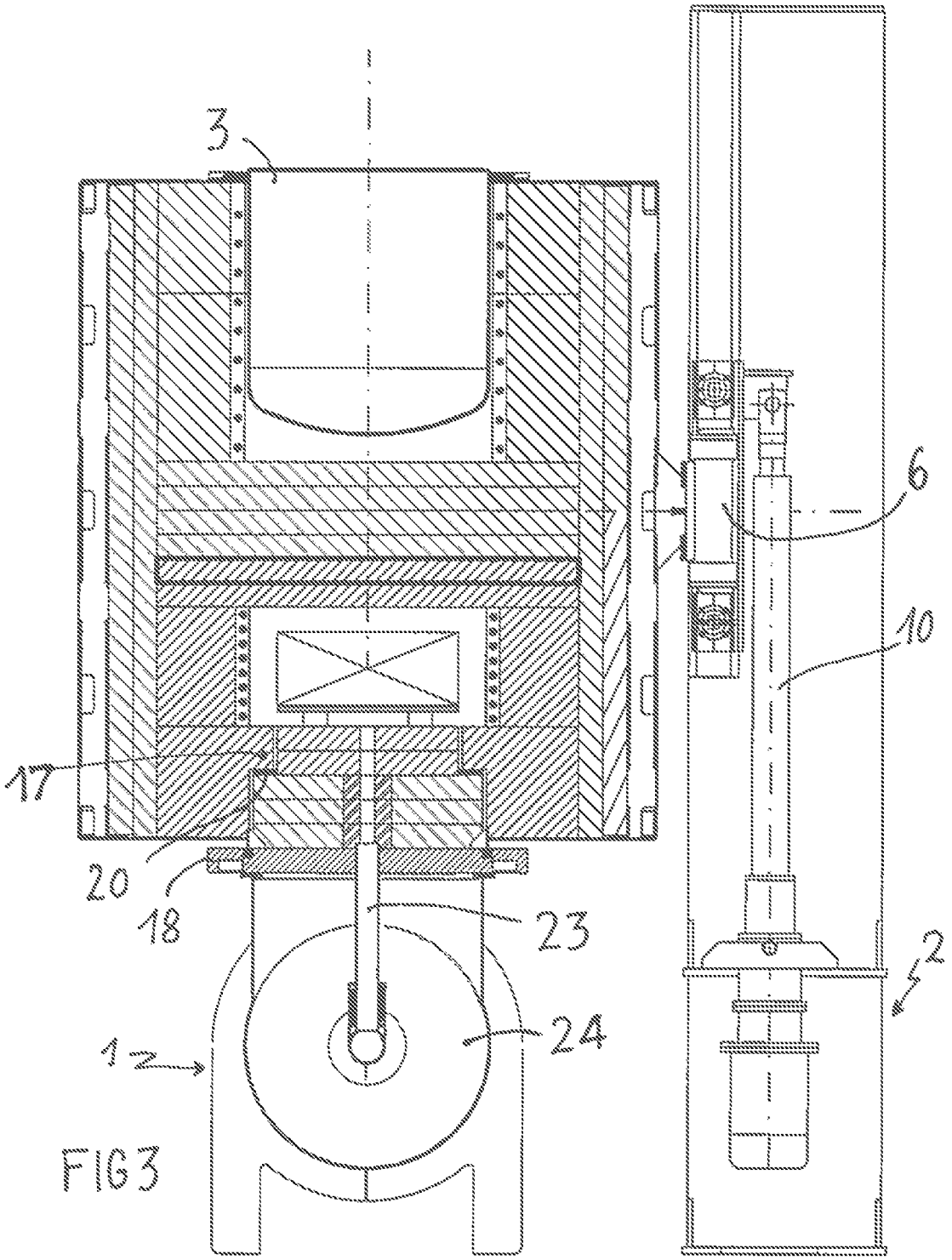
FIG. 3 is a view in vertical section of the heat treatment installation of FIG. 2 after placement of the products in the high-temperature sintering second chamber.

In FIG. 2, after rotation through 180° about the horizontal axis 7, the high-temperature sintering chamber 4 is positioned with its opening over the fixed support 1. The pivot 6 is borne by a carriage 9 that can be moved vertically in the gantry 2 by means of a cylinder 10, preferably a hydraulic cylinder.

The stabilization and binder-removal chamber 3 operates at a temperature of several hundred degrees C. It is made up of a sealed bell housing 11 surrounded with resistive heating elements 12 and lined with low-temperature insulators 13 such as mineral wools.

The high-temperature sintering chamber 4 operates at a temperature that can be as high as around 1600° C. It is made of refractory bricks 14 and ceramic or mineral wool and its active cavity 16 is surrounded with resistive heating elements 15. The active cavity 16 is bordered by a parapet 17.

The fixed support 1 comprises a base 18 bearing a refractory protection 19 with a rim 20, surmounted by a plate 21 able to accept the industrial products 22 that are to be treated. Underneath the plate 21 there opens a duct 23 passing through the base 18 and connecting the treatment chamber 3 or 4 to an atmosphere-control system 24. The atmosphere-control system 24 is able, by means of a fan 25, to extract the gases resulting from the heat treatment of the products 22, to treat them in the zone 26 for the post-combustion of the OCs, and to discharge them via the flue 27. The atmosphere-control system 24 is also able to supply the chamber 3 or 4 with a specific gas such as nitrogen at certain stages in the treatment, from a pressurized gas reserve.

In the first embodiment of FIGS. 1 to 5, the carriage 9 is in the raised position and the stabilization and binder-removal chamber 3 is presented above the support 1. The products 22 that are to be treated are placed on the plate 21 borne by the base 18. The cylinder 10 lowers the carriage 9 until the edge of the chamber 3 is bearing in a sealed manner against the base 18. After the stabilization and binder-removal treatment, the cylinder 10 raises the carriage 9 back up into the raised position. The pivot 6 causes the bearing structure 5 to rotate through 180° so that the sintering chamber 4 is presented above the support 1. The cylinder 10 lowers the carriage 9 until the edge of the chamber 4 is bearing in a sealed manner against the base 18. At the same time, the parapet 17 of the active cavity 16 of the chamber 4 bears in a sealed manner against the rim 20 of the refractory protection 19 borne by the base 18. After a high-temperature sintering treatment, the cylinder 10 raises the carriage 9 back up into the raised position and the treated products 20 can be extracted from the plate 21.

In a second embodiment schematically illustrated in FIG. 6, the fixed support 1 is symbolized by the base 18 bearing the products 22 that are to be treated and the pivot 6, via the bearing structure 5 which is not depicted, bears three chambers: a drying chamber 28, a binder-removal chamber 29, and a high-temperature firing chamber 30. The operations of lowering and raising the pivot are performed by the cylinder 10 as described above. The rotation of the bearing structure 5 is through 120° in order to move on from one chamber to the next.

In a third embodiment also corresponding to the outline of FIG. 6, the gantry 2 bears the pivot 6 at a fixed height, and the base 18 is able to be moved vertically by a cylinder. The drying chamber 28 is positioned above the base 18. The products 22 that are to be treated are placed on the base 18. The cylinder raises the base 18 as far as the drying chamber 28. After the drying operation, the cylinder lowers the base 18. The pivot 6 provides the rotation through 120° of the bearing structure and the binder-removal chamber 29 is presented over the base 18. The cylinder raises the base 18 as far as the binder-removal chamber. After binder removal, the cylinder lowers the base 18 and the pivot 6 provides the rotation through 120° to present the high-temperature firing chamber 30. The cylinder raises the base 18 as far as the chamber 30, and after firing, lowers the base 18 so that the treated products 22 can be recovered.

In this third embodiment, only the base 18 is subjected to the vertical movements. This results in a certain energy saving because the base is markedly less heavy than the bearing structure 5 equipped with three chambers 28,29,30. According to an embodiment variant, the pivot of the bearing structure that bears the chambers has a vertical axis and the chambers are juxtaposed on the bearing structure, each with their opening facing downward. The rotation of the pivot on its vertical axis brings about the switching-over of the chambers. The number of chambers can thus be increased to four. The vertical movement for placing the base in a chamber can be provided either by lowerings of the chamber or by the raising of the base.

The invention is characterized by the use, for successive heat treatments, of dedicated chambers positioned in succession over the products that are to be treated, without any intervention on the spatial organization of the products, such as the stacking or the distribution of the products in the working treatment volume. The base accepts the products and is coupled in succession to each of the treatment chambers, without the products being handled and/or without human intervention for control. This process is particularly well suited to production methods in which it is essential for each manufacturing step to be connected to the subsequent treatments. By way of example, in the case of 3D printing, the manufacturing time may last several tens of hours. The manufacturing batch corresponds to the working volume of the printer. After manufacture, the products are very fragile and need to be stabilized. The stabilization or relaxation treatment may last for 48 hours in an atmosphere in which the temperature and relative humidity are controlled. Next, the binder-removal operation consists in causing the binders contained in the products to be removed, by gasification-combustion, it being possible for the gasification to be performed under vacuum or in a neutral atmosphere. This operation may last from 2 to 3 days depending on the complexity of the products. The oxygen content and the temperature are controlled in order to avoid excessively rapid combustion which might destroy the products. The heating needs to be electrical or indirect in order to avoid contact between the gases and heating elements. The binder-removal operation is performed under a sealed bell housing to avoid the dispersion of pollutant gases. According to one exemplary embodiment, a post combustion in the zone 26 is scheduled to burn off the VOCs resulting from the binder removal. The contaminated gases are extracted through the base via the duct 23.

In the exemplary embodiment described, the second operation described uses a sealed chamber for binder removal. This sealed chamber can be used for any type of heat treatment, under vacuum or under a specific gaseous atmosphere.

The third operation consists of a firing or sintering operation at a high temperature, up to 1650° C. for around 24 hours. This operation needs to be performed in a specific chamber because the bell housing of the binder-removal chamber would not withstand the sintering temperature.

The advantages of the heat treatment installation according to the invention are numerous. Having a single base and several chambers makes it possible to group together on the base a significant proportion of the hardware and of the control functions and, in particular: the gas inlets and outlets for the atmosphere control and for extracting the reaction gases; the gas analyzers and sensors, some of which are multifunctional; the power regulation and control system; the thermal insulation, and the mechanics used for the relative positionings of the base and the various chambers. The fact that the heat treatment operations are strung together without moving around the products that are to be treated ensures a rapid change in treatment conditions, reduces the risk of product degradation, and affords an energy saving.

Finally, the automation of the movements of the chambers according to the various steps of the heat treatment process dispenses with the presence of personnel throughout the duration of the process which may extend over several days.

The invention claimed is:

1. A heat treatment installation for production of industrial products, comprising:

a set of chambers with different thermal characteristics, and a support having: a base to accept and bear products that are to be treated, wherein the support is stationary, the set of chambers are distributed about an axis, and mechanical means provide the relative movement of the base and of the chambers and a coupling between at least one of the set of chambers and the base, wherein the mechanical means includes a motorized pivot for causing the set of chambers to pivot about the axis, and a hydraulic cylinder for causing relative movement of the base and of the set of chambers.

2. The installation as claimed in claim 1, wherein the axis of pivoting of the chambers is a horizontal axis.

3. The installation as claimed in claim 1, wherein the relative movement of the base and of the chambers is a vertical movement.

4. The installation as claimed in claim 3, wherein the vertical movement is a movement of the chambers with respect to the base.

5. The installation as claimed in claim 3, wherein the vertical movement is a movement of the base with respect to the chambers.

6. The installation as claimed in claim 1, wherein the set of chambers comprises two chambers.

7. The installation as claimed in claim 1, wherein the set of chambers comprises three chambers.

* * * * *